United States Patent [19]

Williams

[11] Patent Number: 4,552,113

[45] Date of Patent: Nov. 12, 1985

[54] FUEL CONTROL SYSTEM FOR AN INTERNAL COMBUSTION ENGINE

[75] Inventor: Malcolm Williams, Birmingham, England

[73] Assignee: Lucas Industries Limited, Birmingham, England

[21] Appl. No.: 125,107

[22] Filed: Feb. 27, 1980

[30] Foreign Application Priority Data

Mar. 14, 1979 [GB] United Kingdom ..... 7908992

[51] Int. Cl.[4] ..... F02B 3/00; F02M 7/00

[52] U.S. Cl. ..... 123/436; 123/481; 123/419

[58] Field of Search ..... 123/419, 436, 422, 423, 123/489, 440

[56] References Cited

U.S. PATENT DOCUMENTS

| | | | |
|---|---|---|---|
| 3,789,816 | 2/1974 | Taplin et al. | 123/436 |
| 3,874,171 | 4/1975 | Schmidt et al. | 123/440 |
| 4,138,979 | 2/1979 | Taplin | 123/489 |
| 4,170,201 | 10/1979 | Camp et al. | 60/276 |
| 4,172,433 | 10/1979 | Bianchi et al. | 123/489 |
| 4,195,604 | 4/1980 | Taplin | 123/489 |
| 4,241,710 | 12/1980 | Pederson, Jr. et al. | 123/489 |
| 4,269,156 | 5/1981 | Drellishak | 123/440 |
| 4,294,216 | 10/1981 | Abo et al. | 123/440 |

FOREIGN PATENT DOCUMENTS 2303164 10/1976 France .

*Primary Examiner*—Raymond A. Nelli

*Attorney, Agent, or Firm*—Stevens, Davis, Miller & Mosher

[57] ABSTRACT

An i.c. engine fuel control includes a main fuel control which controls fuel flow to the engine in accordance with one or more engine operating parameters. A roughness sensor provides an electrical signal varying with the magnitude of fluctuations in the engine speed and an integrator integrates the error between this signal and a reference signal. Two active clamp circuits operate to limit the excursion of the integrator output which provides a limited authority trim input to the fuel control.

4 Claims, 5 Drawing Figures

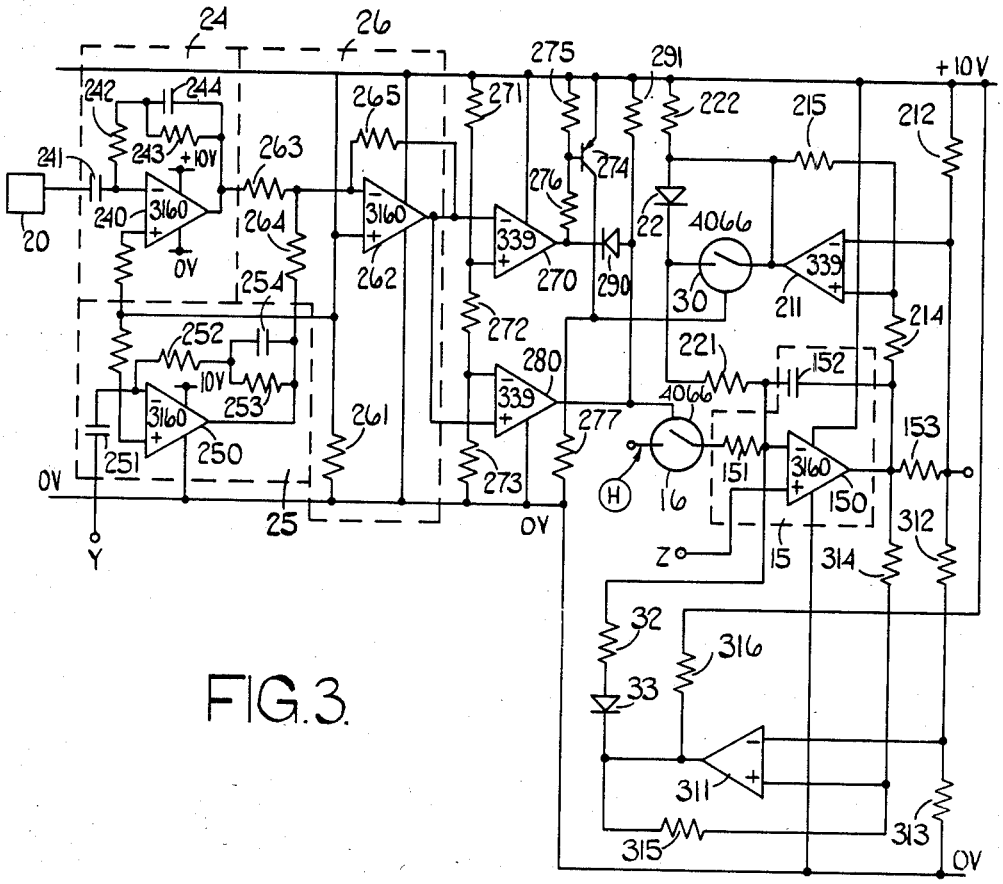
FIG.3.
FIG.4.
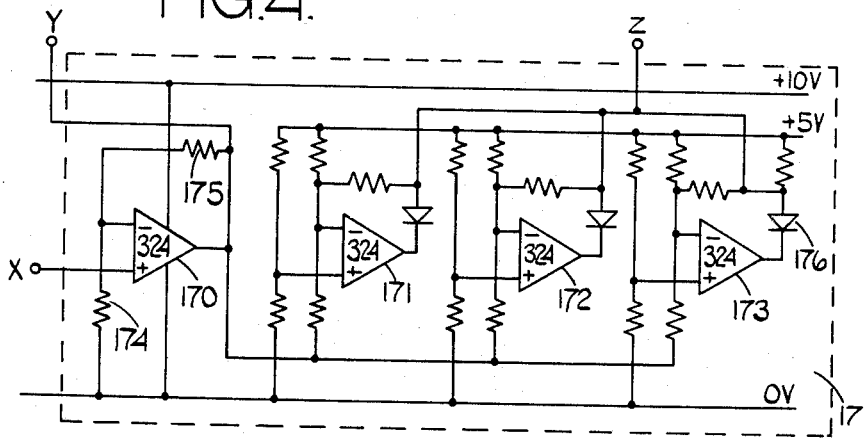

FUEL CONTROL SYSTEM FOR AN INTERNAL COMBUSTION ENGINE

This invention relates to a fuel control system for an internal combustion engine.

It has been found that when the ratio of the fuel supplied to an engine to the air aspirated thereby differs significantly from stoichiometric, rough running of the engine results, that is to say the speed of the engine crankshaft varies significantly within a single revolution of the engine shaft. Such roughness can be measured by comparing the times taken for the engine shaft to turn through given fixed angles in different arcs of rotation.

It has been proposed to apply a roughness sensor to a fuel supply system to provide a form of closed loop control in which the fuel supply is adjusted to maintain a desired level of roughness. In this way it is believed that very economical engine operation with desirably low levels of noxious exhaust emissions can be obtained.

However, since roughness can result from either lean or rich running a control which is intended to increase fuel flow as roughness increases could in certain circumstances have the effect of increasing fuel flow as a result of roughness caused by overrich running. This would increase the roughness to the point where the engine would falter or stop.

Also, even with a very smooth engine, it is undesirable to reduce the fuel to air ratio below a certain level because below this level, for example, the driveability, noxious exhaust emission and fuel consumption may be unsatisfactory. Consequently, a control which reduces fuel flow as roughness decreases could in certain circumstances have the effect of reducing the fuel to air ratio below this level.

It is accordingly an object of the invention to provide a fuel control system in which this problem is overcome.

An internal combustion engine fuel control system in accordance with the invention includes a main fuel control sensitive to one or more engine operating parameters scheduling fuel flow to the engine, and a roughness trim control comprising a roughness sensor circuit providing a roughness signal related to the roughness of running of the engine, said roughness trim control providing an input signal to the main fuel control so as to vary the fuel flow to the engine to obtain a desired level of roughness, said roughness trim control including means limiting the input signal to a predetermined range.

Preferably the roughness trim control includes an electronic integrating circuit which normally provides an output signal corresponding to the integral of the error between said roughness signal and a reference signal.

The trim control may include a pair of active clamp circuits for preventing the input signal to the to the main fuel control going outside said range.

The invention also provides a method of controlling an internal combustion engine comprising supplying fuel to the engine at a rate determined principally by at one engine operating parameter, measuring the roughness of running of the engine so as to derive an electrical signal dependent on the magnitude of fluctuations of the engine speed and using said signal to modify the rate of fuel flow to the engine, said signal having its value limited to a predetermined range so that it exercises only limited authority over the fuel flow.

In the accompanying drawings:

FIGS. 3 and 4 are circuit diagrams of a further part of the circuit of FIG. 1.

Figure 1:
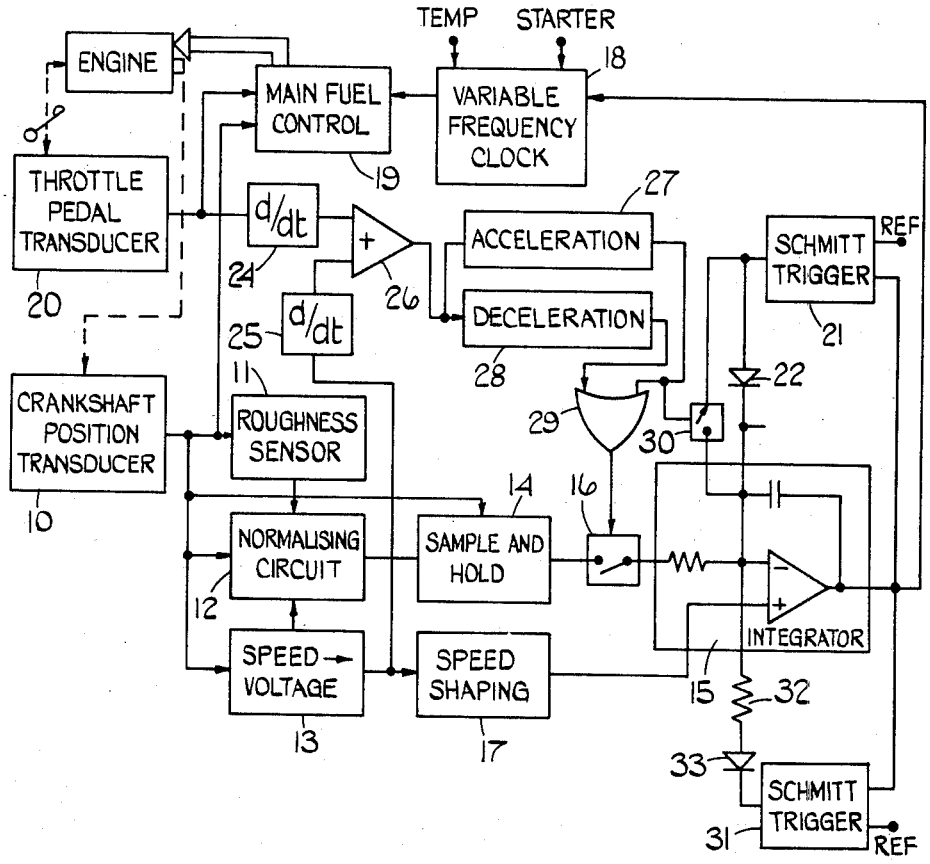
FIG. 1 is a block diagram of an example of a fuel control circuit in accordance with the invention.

Referring firstly to FIG. 1, the circuit shown includes an engine crankshaft position transducer circuit 10 which produces output pulses at fixed positions of the engine crankshaft. By way of example a transducer which produces one pulse for every 180° of rotation of the engine shaft may be used. This transducer provides input pulses to a roughness sensor circuit 11 which produces an output pulse whenever the length of time interval between two transducer pulses exceeds the time interval between the preceding transducer pulse and the first of two pulses. The duration of this output pulse is slightly less than the difference between these two time intervals as will be explained hereinafter. This duration is dependent both on the difference in shaft speed in the two 180° arcs involved, but is also dependent on the average speed.

A normalising circuit 12 is provided to process the pulse from the roughness sensor circuit and produce an output signal dependent on the ratio of the change in speed to the average speed and this normalising circuit has an input from a speed signal generating circuit 13 which produces an output related to engine speed by processing the pulses from the transducer circuit 10.

The output from the normalising circuit is fed to a sample and hold circuit 14 up dated periodically by pulses from the transducer circuit 10. As will be explained in greater detail hereinafter, the transducer circuit 10 in fact has several difference outputs which are variously used by the roughness sensor circuit 11, the normalising circuit 12, the speed signal generating circuit 13 and the sample and hold circuit 14.

The output of the sample and hold circuit 14 is connected to one input of an integrating circuit 15 via an electronic switch 16. A speed shaping circuit 17 which receives its input from circuit 13 provides an input to a reference terminal of the integrator so that the integrator normally produces an output signal dependent on the integral of the error between the roughness signal from the sample and hold circuit 14 and the speed dependent reference signal from the speed shaping circuit 17.

The output of the integrator 15 is used to vary the frequency of a clock circuit 18 which provides a clock input to a main fuel control circuit 19, which controls the flow of fuel to the vehicle engine. The circuit 19 which is of known construction operates by periodically generating a multi-bit digital signal as a function of input signals it receives for example from a throttle pedal transducer 20 and the position transducer circuit 10, which multi-bit digital signal represents the scheduled quantity of fuel required by the engine for that throttle/speed combination. This multi-bit signal is used to determine the quantity of fuel supplied to the engine by energising a fuel injection valve for the period of time required for the clock circuit 18 to produce the number of pulses represented by the multi-bit digital signal. When the output of the integrator 15 is at an upper reference level the frequency of the clock is such that the quantity of fuel injected is approximately sufficient to provide a stoichiometric air/fuel ratio. The circuit is such however, that the output of the integrator is normally lower than this upper reference level and this has the effect of increasing the clock frequency and thereby reducing the quantity of fuel injected.

The output of the integrator 15 is, in fact, not permitted to rise above the reference level referred to, an active clamp circuit including a schmitt trigger circuit 21 and a diode 22 being provided for this purpose.

When the output of the integrator 15 is at a lower reference level the frequency of the clock 18 is such that the quantity of fuel injected corresponds to the leanest air/fuel ratio which is acceptable taking into consideration factors such as vehicle driveability, fuel consumption and noxious exhaust emissions. The output of integrator 15 is prevented from falling below this lower reference level by a second active clamp circuit including a schmitt trigger circuit 31, a resistor 32 and a diode 33.

In order to prevent the fuel flow to the engine being affected by the roughness outputs which is produced during normal acceleration and deceleration of the engine resulting from movement of the throttle pedal by the driver of a vehicle in which the circuit is installed, two differentiating circuits 24, 25 are connected to the throttle pedal transducer 20 and the output of the speed signal generator 13 respectively. The outputs of these two differentiating circuits 24, 25 are connected to a summing amplifier 26, the output of which is connected to the inputs of an acceleration sensing circuit 27 and a deceleration sensing circuit 28. The outputs of these two circuits are connected to an OR gate 29 which controls the electronic switch 16 and the output of the circuit 27 is also arranged to control a further electronic switch 30 which is in parallel with the diode 22. The effect of these circuits is that during acceleration, the output of the integrator 15 is driven rapidly to the reference level irrespective of the output of the roughness sensing circuit and in deceleration, the output of the integrator is held constant at the level it was at when the deceleration commenced.

Figure 2:
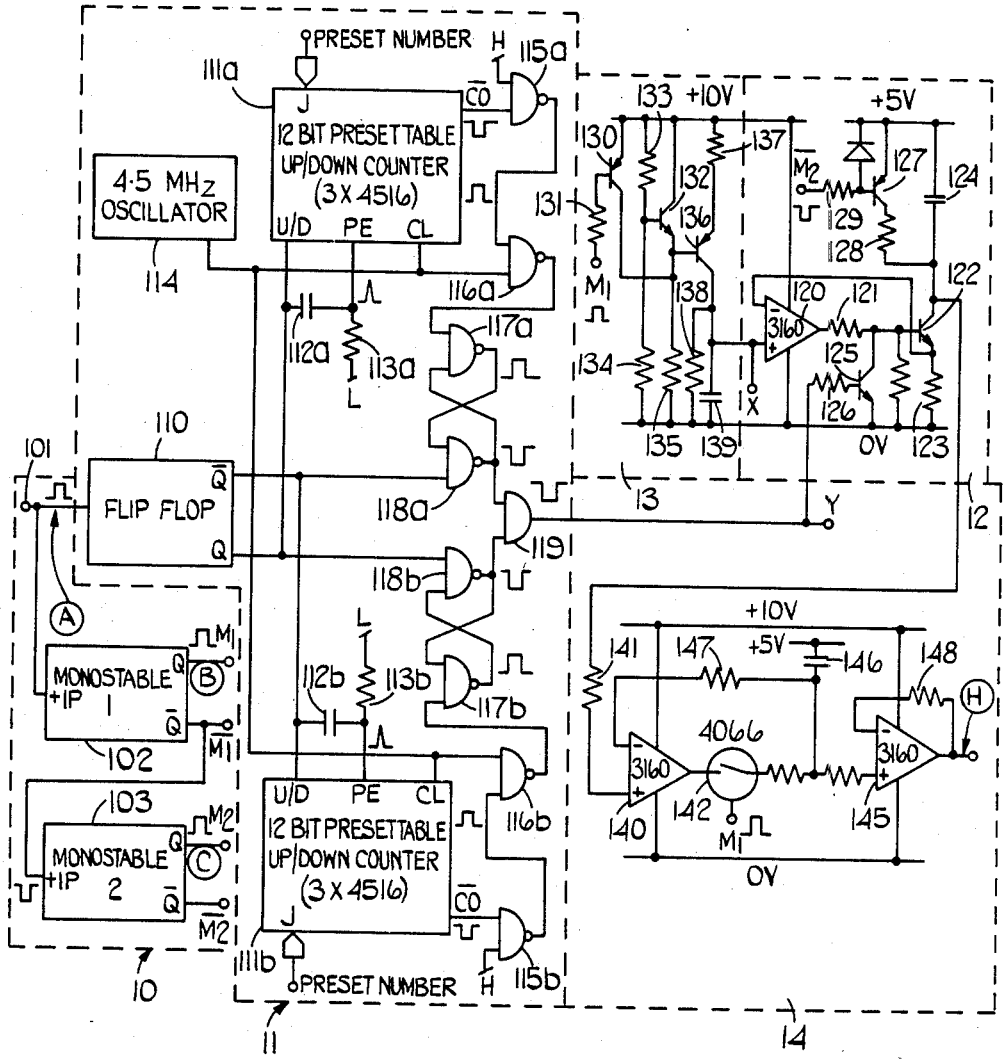
FIG. 2 is an electric circuit diagram of a roughness sensor circuit forming a part of the circuit shown in FIG. 1.

Turning now to FIG. 2, the speed transducer circuit 10 includes an actual transducer 101, which produces a positive going pulse (graph A in FIG. 5) at 180° intervals of crankshaft rotation. The transducer 101 is connected to a first monostable circuit 102 which is triggered by the rising edge of each output pulse from the transducer 101 and produces at its Q output a positive going pulse of fixed duration (graph B in FIG. 5) and a corresponding negative going pulse at its $\overline{Q}$ output. A second monostable circuit 103 is connected to be triggered by the rising edge of this negative going pulse and produces at its Q output a fixed length pulse immediately following each pulse at the Q output of the first monostable circuit 102, (graph C in FIG. 5).

Figure 5:
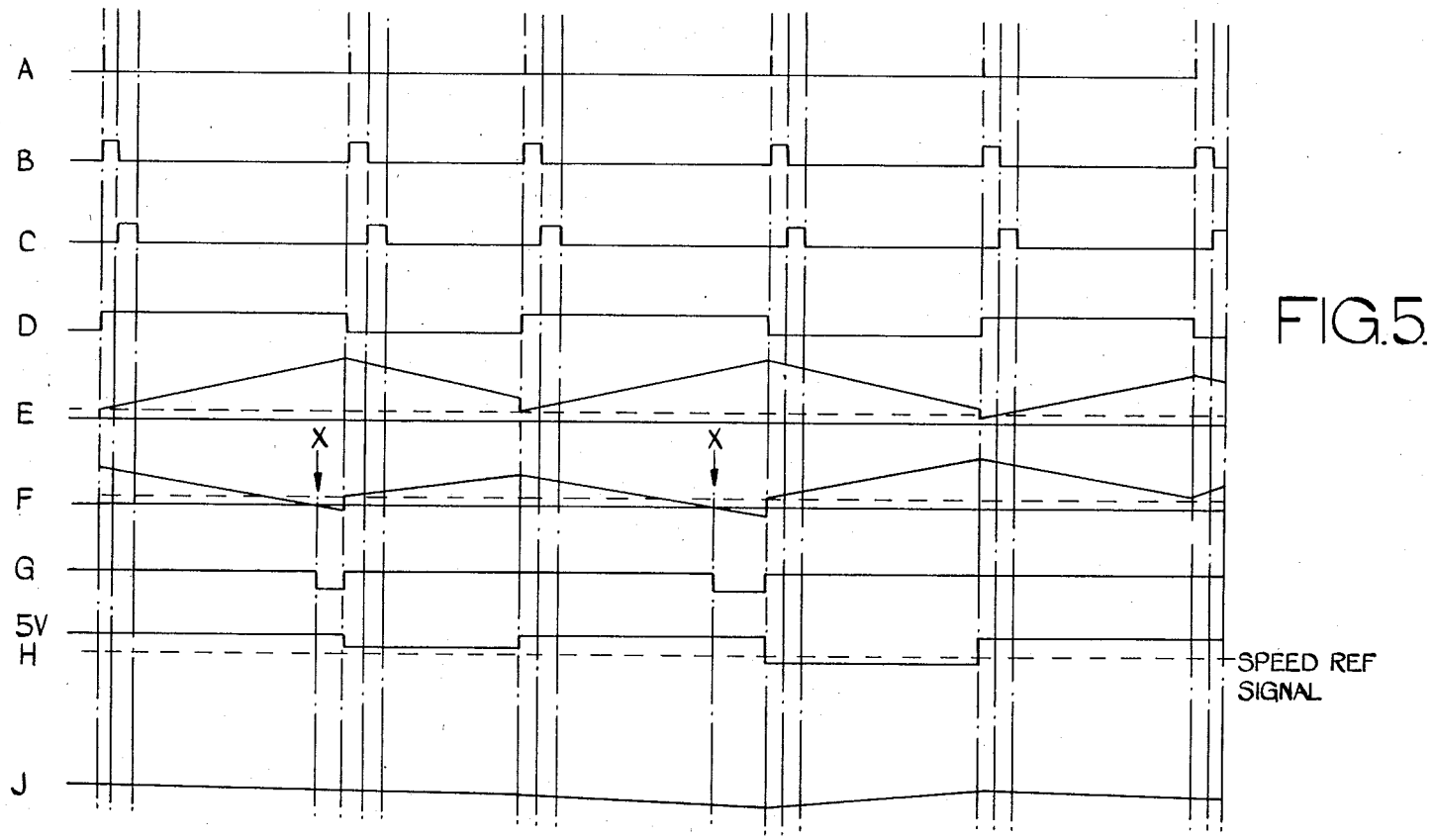
FIG. 5 is a graph showing wave forms at a series of positions in FIGS. 2, 3 and 4.

The roughness sensing circuit utilises the output (A) of the transducer 101 which is used to trigger an input flip-flop circuit 110, the wave form at the Q output of which is shown in graph D of FIG. 5. The Q and $\overline{Q}$ outputs of the flip-flop circuit 110 are connected to the UP/DOWN terminals of two 12-bit-counters (each consisting of three 4516 type CMOS integrated circuits in cascade), 111*a*,111*b*. Each counter 111*a*, 111*b* has its PRESET ENABLE terminal connected by a capacitor 112*a*, 112*b*, to its UP/DOWN terminal and by a resistor 113*a*, 113*b* to a ground rail. The CLOCK terminals of both counters are connected to a 4.5 MHz oscillator 114. Graphs E and F show the respective count states of the counters 111*a* 111*b*. The data input terminals of the counters are connected to provide a small initial count in each counter when it starts counting up, so that no carry out signal is produced by the counter if the counter counts up and then down for exactly equal periods. A carry out signal is only produced if the count down period exceeds the count up period which, as shown in FIG. 4 occurs in the case of counter 111*b* at the two points marked "X".

The CARRY OUT terminal of each counter is connected to a NAND gate 115*a*, 115*b* connected to act as a logical inverter, and the output of that NAND gate is connected to one input of a further NAND gate 116*a*, 116*b* which has its other input connected to the oscillator 114. The output terminal of the NAND gate 116*a*, 116*b*, is connected to one input terminal of a toggle circuit constituted by two cross connected NAND gates 117*a*, 117*b* and 118*a*, 118*b* the other input of which is connected to the one Q or $\overline{Q}$ outputs of flip-flop circuits 110, which is connected to the other counter 111*a* or 111*b*. The outputs of NAND gates 118*a*, 118*b* are connected to an AND gate 119 the output of which is shown in graph G of FIG. 5.

As will be appreciated, each toggle circuit is only set when the associated counter produces a carry-out signal during count down. This toggle circuit is subsequently reset by the next transducer pulse, so that the duration of the negative going output of AND gate 119 is the difference between the time period between first and second transducer pulse and the time period between the preceding transducer pulse and the first transducer pulse, less whatever small error is introduced by the small preset count introduced into the counters 111*a*, 111*b*.

The speed signal generating circuit 13 is basically a frequency to voltage converter operated by the Q output of monostable circuit 102. The circuit 13 includes an input pnp transistor 130 having its base connected by a resistor 131 to the Q output of monostable circuit 102 and its emitter connected to a +10 v rail. An npn transistor 132 has its base connected to the junction of two resistors 133, 134 which are in series between the +10 v rail and a ground rail, its collector connected to the +10 v rail and its emitter connected via a resistor 135 to the ground rail. The collector of transistor 130 is connected to the emitter of transistor 132. An output pnp transistor 136 has its base connected to the emitter of transistor 132, its emitter connected to the +10 v rail by a resistor 137 and its collector connected to the ground rail by a resistor 138 and a capacitor 139 in parallel. When the transistor 130 is off, which occurs for the duration of the Q output pulse of monostable circuit 102, the emitter of transistor 132 is held at a fixed voltage so that a fixed current flows into resistor 138 and capacitor 139. When the transistor 130 is on, which is for the remaining time period, transistor 136 is held off and capacitor 139 discharges through resistor 138. The mean voltage at the collector of transistor 136 is directly proportional to engine speed.

The normalising circuit 12 includes an operation amplifier 120 having its non-inverting input terminal connected to the collector of the transistor 136. The output terminal of this operational amplifier 120 is connected by a resistor 121 to the base of an npn transistor 122 the emitter of which is connected by a resistor 123 to the ground rail and also connected to the inverting input terminal of the operational amplifier so that the operational amplifier and transistor act as a voltage to current converter in known manner. The collector of the transistor 122 is connected by a capacitor 124 to the +5 v rail so that this capacitor charges up at a rate directly proportional to the voltage at the non-inverting input of amplifier 120.

An npn transistor 125 has its emitter connected to the ground rail and its collector connected to the base of transistor 122. The base of transistor 125 is connected by a resistor 126 to the output terminal of AND gate 119 so that transistor 125 is on and thereby holds transistor 122 off except when the output of AND gate 119 is low.

For periodically discharging the capacitor 124, there is a pnp transistor 127 which has its emitter connected to the +5 v rail and its collector connected by a resistor 128 to the collector of transistor 122. A resistor 128 connects the base of transistor 127 to the $\overline{Q}$ output of the monostable circuit 103. Transistor 127 is conductive only while the Q output of circuit 103 is high.

Each $\overline{Q}$ output from the circuit 103 discharges capacitor 124 and transistor 122 remains off until a negative going pulse is produced by the AND gate 119. Transistor 122 then turns on and capacitor 124 charges to a voltage corresponding to the product of the output of the speed sensing circuit 13 and the duration of the low output of AND gate 119. This voltage signal is held on the capacitor 124 for the duration of the high output at the Q output terminal of circuit 102, which commences as transistor 122 is switched off again. The capacitor 124 is then discharged again.

This voltage signal is representative of the speed-normalised roughness.

The sample and hold circuit 14 includes an input amplifier 140 which has its non-inverting input terminal connected by a resistor 141 to the collector of transistor 122. The output terminal is connected by an electronic switch element 142 (controlled by the Q output of circuit 102) and two resistors 143, 144 in series to the non-inverting input of an output buffer amplifier 145, the junction of resistors 143, 144 being connected by a capacitor 146 to a +5 v rail and by a resistor 147 to the inverting input terminal of amplifier 140. A resistor 148 connects the output of amplifier 145 to its inverting input.

The output (shown in graph H of FIG. 5) of the amplifier 145 is at +5 v in any period between two successive crankshaft transducer pulses if no roughness pulse was produced by AND gate 119 immediately before the first of those pulses. If a roughness pulse is produced the output of the amplifier 145 falls linearly with increasing normalised roughness, i.e. a short roughness pulse at a given speed causes the voltage to take up a level slightly below +5 v and a longer roughness pulse at the speed causes it to take up an even lower level.

Turning now to FIGS. 3 and 4, the output of amplifier 145 is applied via the electronic switch element 16 to the integrator 15 which includes an operational amplifier 150 having its inverting input connected by a resistor 151 to the switch 16 and its output connected to its inverting input by a capacitor 152. The output of amplifier 150 is connected to the variable frequency clock by a resistor 153.

The non-inverting input of the amplifier 150 is connected to the output of the speed-shaping circuit 17 which as shown in FIG. 4, includes four operational amplifiers 170, 171, 172 and 173. The amplifier 170 has its non-inverting input connected to the collector of transistor 136 and its inverting input connected to the junction of two resistors 174, 175 in series between the output terminal of the amplifier 170 and the ground rail. The other three amplifiers 171, 172, 173 are connected with various resistors and diodes as shown to operate in known manner to provide an output which is between 0 and 5 v when the signal at the collector of transistor 136 is at 0 volts and which rises linearly in three segments of decreasing slope as the signal at the collector of transistor 136 rises. The output of amplifier 173 is connected to the cathode of a diode 176, the anode of which is connected to the output of the circuit 17.

The output of amplifier 150 is thus normally the integral of the error between the signal at point H and at the reference signal generated by the speed shaping circuit 17. This output is shown in graph J of FIG. 5 assuming the speed to be constant throughout.

The throttle signal differentiation circuit 24 comprises an operational amplifier 20 with its inverting input terminal connected by a capacitor 241 to the output of the pedal transducer 20 and has a feedback circuit consisting of two resistors 242, 243 in series between the output terminal of amplifier 240 and its inverting input and a capacitor 244 across one of these resistors 243 to limit the high frequency gain of the amplifier. The differentiator 25 is similar, consisting of an operational amplifier 250 resistors 252, 253 and capacitors 251, 254, the inverting input of amplifier 250 being connected to the output of amplifier 170 of the speed shaping circuit 17. The non-inverting inputs of the amplifiers 240, 250 are connected by respective resistors 245, 255, to the junction of two resistors 260, 261 which are shown in FIG. 3 as part of the summing amplifier 25.

Summing amplifier 26 includes an operational amplifier 262 which has its non-inverting input connected to the junction of resistors 260, 261 which are in series between the +10 v rail and the ground rail. The outputs of the amplifiers 240, 250 are connected by respective resistors 253, 254 to the inverting input of amplifier 262 which has a resistor 265 connected between its output and its inverting input.

The acceleration and deceleration sensing circuits 27 and 28 are constituted by a pair of voltage comparators 270 and 280 which have reference voltages applied to their non-inverting and inverting inputs respectively by different points on a resistor chain 271, 272, 273. The output of amplifier 262 is connected to the non-inverting input of comparator 280 and the inverting input of comparator 270.

The OR gate 29 is constituted quite simply by a diode 290 which has its cathode connected to the output of comparator 280 and its anode connected by a resistor 291 to the +10 v rail. The anode of diode 290 is connected to the control input of switch element 16 as is the output of comparator 280. This switch element 16 goes open circuit if the output of comparator 270 is low, or if the output of comparator 280 is low. Comparator 270 output goes low only when the accelerator pedal is actually being depressed or when the engine speed is actually increasing, and similarly the comparator 280 output goes low only when the accelerator pedal is being raised or actual deceleration of the engine is in progress. In cruising conditions both comparator outputs are high so that the switch element 16 is "closed".

The Schmitt trigger circuit 21 comprises a voltage comparator 211 having its inverting input connected to the +10 v rail by a resistor 212 and to the output of amplifier 150 by the resistor 153. The output of amplifier 150 is connected by a resistor 214 to the non-inverting input of comparator 211 and the d.c. positive feedback needed for comparator 211 to operate as a Schmitt trigger is provided by a resistor 215 connected between the output of comparator 211 and its non-inverting input. The diode 22 has its anode connected to the output of comparator 211 and its cathode connected by a resistor 221 to the inverting input of amplifier 150. A resistor 222 is connected between the anode of the diode 22 and the +10 v rail.

The Schmitt trigger circuit 31 comprises a voltage comparator 311, the inverting input of which is connected to the junction of two resistors 312, 313, these resistors being connected in series between the junction of resistors 212 and 153 and the ground rail. The output of amplifier 150 is connected via a resistor 314 to the non-inverting input of comparator 311 and the d.c. positive feedback needed for comparator 311 to operate as a Schmitt trigger is provided by a resistor 315 connected between the output of comparator 311 and its non-inverting input. The output of amplifier 311 is connected to the +10 v rail through a resistor 316 and also to the cathode of diode 33, the anode of which is connected through a resistor 32 to the inverting input of amplifier 150.

As explained above, the Schmitt trigger circuits 21 and 31 act to limit the range of output voltages of the amplifier 150, and consequently the range of output voltages provided to the clock 18, by each providing an active clamp. Provided the output of the integrator 15 remains below an upper reference level (set by resistors 212, 153, 312 and 313), the output of comparator 211 remains low, diode 22 preventing it from having any effect on the integrator output. Should the output of integrator 15 happen to rise above the upper reference level the output of the comparator 211 will go high so that extra current flows into the inverting input of the amplifier 150 causing the output to ramp down until the Schmitt trigger reset threshold is reached. Likewise, provided the output of the integrator 15 remains above a lower reference level (also set by resistors 212, 153, 312 and 313), the output of comparator 311 remains high, diode 33 preventing it from having any effect on the integrator output. Should the output of integrator 15 happen to fall below the lower reference level the output of comparator 311 will go low causing the output of the amplifier 150 to ramp up until the Schmitt trigger threshold is reached. Resistors 221 and 32 are an order of magnitude smaller than resistor 151 so that such resetting occurs rapidly.

The acceleration sensing circuit 27 also includes a pnp transistor 274 which has its emitter connected to the +10 v and its base connected to the junction of two resistors 275, 276 which are in series between the output of the amplifier 270 and the +10 v rail. The collector of the transistor 274 is connected by a resistor 277 to the ground rail and is also connected to the control terminal of the electronic switch 30. Switch 30 "closes" whenever acceleration is demanded or is actually taking place.

The control circuit described above provides for closed loop fuel control based on roughness sensing. The counter system used for generating the "raw" roughness pulse ensures an accurate roughness output with a reasonably high response speed. The normalising circuit employed also provides a good degree of accuracy and the inclusion of the integrating circuit ensures that stable operation is obtained. The Schmitt trigger circuit 21 ensures that the closed loop roughness control can only reduce fuel flow below the scheduled flow for the specific throttle/speed relationship, so that "digging in" caused by enrichment when the engine is already running rich cannot occur and the Schmitt trigger circuit 31 ensures that the closed loop roughness control cannot reduce the fuel flow below the least acceptable air/fuel ratio. The acceleration and deceleration loop inhibiting controls have no effect on the roughness sensing circuit itself which continues to provide an output during deceleration (but not during acceleration, because each 180° time interval will be shorter than the last unless the engine is running exceptionally roughly). Closed loop control is restored as soon as acceleration or deceleration ceases and in the case of deceleration the output of the integrator 15 is the same as it was before the deceleration commenced. In the case of an acceleration "closing" of electronic switch causes the output of integrator 15 to ramp up (since the output of Schmitt trigger 21 is low at this stage), until the Schmitt trigger fires. The integrator output then oscillates between the upper and lower Schmitt trigger thresholds until acceleration ceases at which time closed loop operation is re-established.

I claim:

1. An internal combustion engine fuel control system comprising a main fuel control sensitive to one or more engine operating parameters scheduling fuel flow to the engine, and a roughness trim control comprising a roughness sensor circuit providing a roughness signal related to the roughness of running of the engine, said roughness trim control including an integrator having an output providing an input signal to the main fuel control so as to vary the fuel flow to the engine to obtain a desired level of roughness, and a first active clamp circuit which has an input and an output connected respectively to an output and input of the integrator, said clamp circuit comprising a means for preventing said integrator output from exceeding a maximum acceptable level of enleanment, and a second active clamp circuit comprising means for preventing said integrator output from exceeding a minimum acceptable level of enleanment, each of said active clamp circuits has its input connected to the output of the integrator and its output connected to the input of the integrator so as to maintain the integrator output at or near a predetermined level when that clamp circuit is in operation, wherein each clamp circuit includes a Schmidt trigger circuit.

2. An internal combustion engine fuel control system comprising a main fuel control sensitive to one or more engine operating parameters scheduling fuel flow to the engine, and a roughness trim control comprising a roughness sensor circuit providing a roughness signal related to the roughness of running of the engine, said roughness trim control including an integrator having an output providing an input signal to the main fuel control so as to vary the fuel flow to the engine to obtain a desired level of roughness, and a first active clamp circuit which has an input and an output connected respectively to an output and input of the integrator, said clamp circuit comprising a means for preventing said integrator output from exceeding a maximum acceptable level of roughness related enleanment, wherein said preventing means comprising a Schmidt trigger circuit.

3. An internal combustion engine fuel control system comprising a main fuel control sensitive to one or more engine operating parameters scheduling fuel flow to the engine, and a roughness trim control comprising a roughness sensor circuit providing a roughness signal related to the roughness of running of the engine, said roughness trim control including an integrator having an output providing an input signal to the main fuel control so as to vary the fuel flow to the engine to obtain a desired level of roughness, and a first active clamp circuit which has an input and an output connected respectively to an output and input of the integrator, said clamp circuit comprising a means for preventing said integrator output from exceeding a maximum acceptable level of enleanment, and a second active clamp circuit comprising means for preventing said integrator output from exceeding a minimum acceptable level of enleanment, said preventing means comprising a Schmidt trigger circuit.

4. A system as claimed in claim 2 or 3 in which each Schmidt trigger circuit includes an operational amplifier having its non-inverting input connected to the integrator output, its inverting input connected to a reference voltage and its output connected by a feedback resistor to non-inverting input and by a diode and a resistor in series to the integrator input.

* * * * *